US010472965B2

(12) United States Patent
Galin et al.

(10) Patent No.: US 10,472,965 B2
(45) Date of Patent: Nov. 12, 2019

(54) ELECTROMAGNETIC ONLY VANE COORDINATION OF A CAT AND MOUSE ENGINE

(71) Applicants: Anatoli Galin, Sydney (AU); Oleksandr Galin, Chernivtsi (UA); Natalia Galin, Sydney (AU); Volodymyr Galin, Chernivtsi (UA)

(72) Inventors: Anatoli Galin, Sydney (AU); Oleksandr Galin, Chernivtsi (UA); Natalia Galin, Sydney (AU); Volodymyr Galin, Chernivtsi (UA)

( * ) Notice: Subject to any disclaimer, the term of this patent is extended or adjusted under 35 U.S.C. 154(b) by 126 days.

(21) Appl. No.: 15/544,029

(22) PCT Filed: Jun. 17, 2016

(86) PCT No.: PCT/AU2016/000212
§ 371 (c)(1),
(2) Date: Jul. 25, 2017

(87) PCT Pub. No.: WO2016/201490
PCT Pub. Date: Dec. 22, 2016

(65) Prior Publication Data

US 2018/0106151 A1 Apr. 19, 2018

(30) Foreign Application Priority Data

Jun. 19, 2015 (AU) ..... 2015902378
Jul. 11, 2015 (AU) ..... 2015902743

(51) Int. Cl.

| | |
|---|---|
| ***F01C 1/063*** | (2006.01) |
| ***F01C 20/08*** | (2006.01) |
| ***F04C 2/063*** | (2006.01) |
| ***F04C 23/02*** | (2006.01) |
| ***F01C 21/00*** | (2006.01) |
| ***F01C 17/00*** | (2006.01) |
| ***F02B 53/14*** | (2006.01) |

(52) U.S. Cl.
CPC ..... *F01C 1/063* (2013.01); *F01C 17/00* (2013.01); *F01C 20/08* (2013.01); *F01C 21/008* (2013.01); *F02B 53/14* (2013.01); *F04C 2/063* (2013.01); *F04C 23/02* (2013.01); *F04C 2270/035* (2013.01); *F04C 2270/0525* (2013.01); *F04C 2270/605* (2013.01)

(58) Field of Classification Search
CPC ..... F01C 17/00; F01C 1/063; F01C 21/008; F02B 53/14; F04C 2270/035; F04C 2270/0525; F04C 2270/605; F04C 23/02; F04C 2/063
See application file for complete search history.

(56) References Cited

U.S. PATENT DOCUMENTS

| | | | | |
|---|---|---|---|---|
| 7,474,020 B2 * | 1/2009 | Pal | H02K 7/1884 310/14 |
| 8,950,377 B2 * | 2/2015 | Drachko | F01C 1/077 123/245 |
| 2015/0188400 A1 * | 7/2015 | Kemp | H02K 53/00 310/74 |

* cited by examiner

*Primary Examiner* — Mary Davis

(57) ABSTRACT

A rotary-vane internal combustion engine of the cat and mouse or scissor type with coordinated rotation of two co-axial shafts with position sensors creating chambers of variable volume for intake, compression, power and exhaust strokes. A reversible electric generator motor on at least one of the shafts with an electronic control system for current, an energy storage unit and electrical load. The total work done and angular speed is calculated or empirically determined while an alternating accelerating or decelerating torque is applied for a continuous, uniform rotation cycle.

7 Claims, 3 Drawing Sheets

ELECTROMAGNETIC ONLY VANE COORDINATION OF A CAT AND MOUSE ENGINE

TECHNICAL FIELD

This invention relates to rotary-vane machines that convert heat energy to electrical energy.

BACKGROUND ART

The concept of the rotary-vane machine (RVM) has been known for a long time, and continues to attract attention due to a number of advantages it has over machines utilizing reciprocating piston motion. Some of the advantages of the RVM are: mechanical simplicity, fewer parts, time-independent lever arm for gas pressure forces, and easier compensation of forces that act to bend the shafts.

There is reason to assert that in the RVM conditions for complete combustion of fuel are better observed, making the machine environmentally cleaner when compared with conventional piston engines. According to the Le Chatelier-Braun principle, the process of fuel combustion in a confined volume that releases heat and increases pressure is stimulated by an increase in volume, as an increase in volume causes pressure to decrease. In the RVM, the volume of the power stroke chamber increases at a greater rate than in a comparable reciprocating piston machine. This fact inspires confidence that the combustion of fuel in a RVM will be more complete, and hence that operation of the RVM will bring less harm to the natural environment.

There have been numerous attempts to build RVMs, and there exist a large number of patents of various designs, however, to this day, not one of the many proposed constructions has been successful in practical testing.

In a RVM, to realize the cycles of internal combustion it is necessary to ensure coordinated rotation of the shafts. The main cause of failure in all known and proposed variants of RVM construction is that they employ mechanical linkages to coordinate shaft rotation; none of the proposed variants are sufficiently reliable and capable of long-term operation. Components in these mechanical linkages experience alternating shock loadings, which quickly lead to their destruction, and consequently inoperability of the RVM.

An example of a known rotary vane engine invention is patent RU2237817, which proposes attaching reversible electrical machines (REM) onto the shafts of the engine, but, to keep the trailing vane from rotating backwards, proposes a mechanical linkage (a locking device or ratchet) which makes the device practically unusable due to unavoidable quick wear and tear of this mechanical part. Other designs, for example WO 2008/081212 A1, also propose to install REMs onto shafts, and also propose mechanical stopper devices to ensure motion of the rotor in one direction only.

SUMMARY OF INVENTION

Technical Problem

The technical task is to find a simple, and reliable method of coordinating the rotation of the shafts of a RVM, without employing mechanical linkages to affect the rotation of the shafts.

Solution to Problem

In the disclosed method and device, coordinated rotation of shafts of a RVM is achieved through the application of accelerating, and decelerating torques applied to the shafts from either one or two REMs; no mechanical linkages are used to affect the nature of rotation of the shafts. A commutator controls the current supplied to the REM(s). The commutator is in turn controlled by a computing device, which receives shaft position information from sensors.

Advantageous Effects of Invention

The disclosed method and device are a radical solution to the problem of coordination of rotation of shafts in a RVM, and eliminates reliability problems of this mechanism.

DESCRIPTION OF EMBODIMENTS

Figure 1:
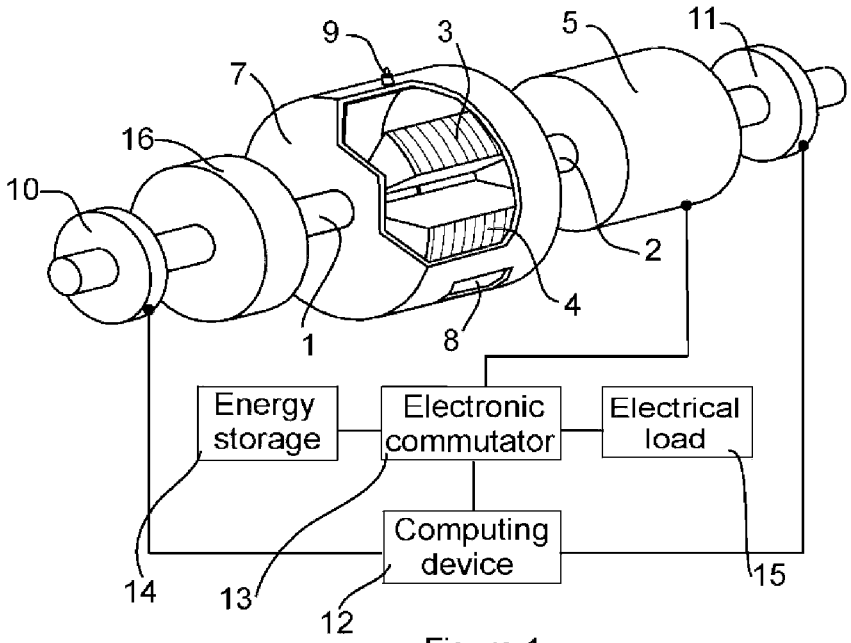
FIG. 1 depicts an embodiment of the device with one reversible electrical machine attached to one of the shafts.
Figure 2:
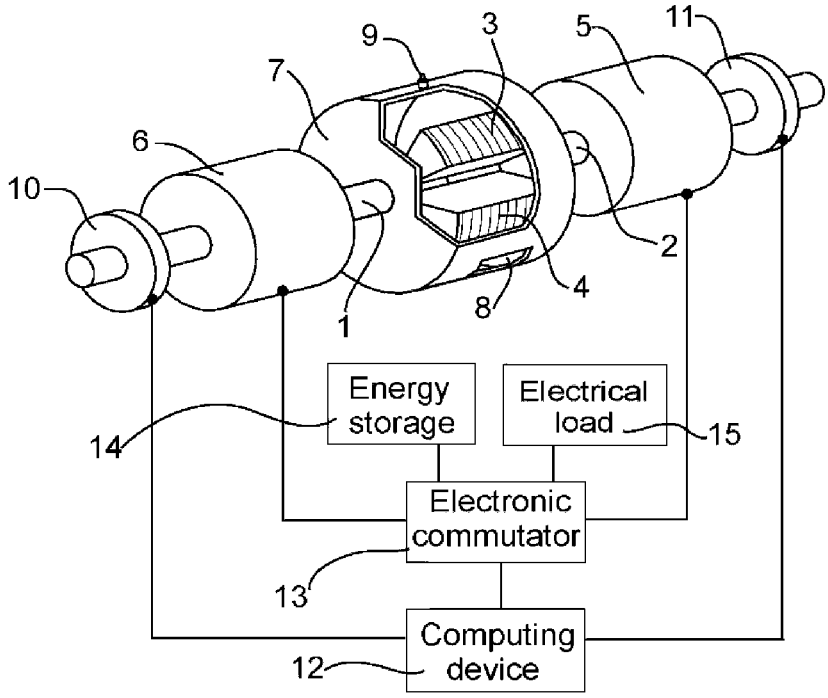
FIG. 2 depicts an embodiment of the device with two reversible electrical machines attached to each shaft.

General forms of RVMs with one and two reversible electrical machines are depicted in FIG. 1 and FIG. 2, wherein two vanes are attached to the first and second shaft of the RVM in such a way so that vanes 3 of shaft 1 alternate with vanes 4 of shaft 2. As the angle between the shafts changes, the volume of the chambers between the vanes also changes. FIG. 1 depicts a RVM with a REM 5 attached to shaft 2, and a flywheel 16 attached to shaft 1. FIG. 2 depicts a RVM with two REMs, 6 and 5 attached to shaft 1 and shaft 2 respectively.

In both FIG. 1 and FIG. 2, vanes are enclosed within a cylindrical casing 7, which has an opening for the intake of gases 8 and a second opening (not shown) for the exhaust of gases on the other side of the casing. There is a device for ignition 9 on the side of the cylindrical casing 7, which can either be a spark plug or an injection nozzle that sprays fuel into the hot air which is at a sufficiently high temperature for ignition to occur. Position sensors 10 and 11 are fixed to the shafts 1 and 2 respectively and are used to inform the computing device 12 of the positions of the shafts. A commutator 13 controls electrical currents in REM 5 FIG. 1, and REM 5 and REM 6 in FIG. 2. The computing device 12 controls the electronic commutator. The stators of REM 5 in FIG. 1 and REMs 5 and 6 in FIG. 2 and the cylindrical casing 7 are fixed to a common stationary base (not shown). The energy storage unit 14 serves as a buffer for temporary storage of electrical energy for powering the REM(s), and for offering continuous energy flow to the electrical load 15. The electrical load 15 is consumer of all energy produced by the RVM(s) during their continuous, uniform operation.

Figure 3:
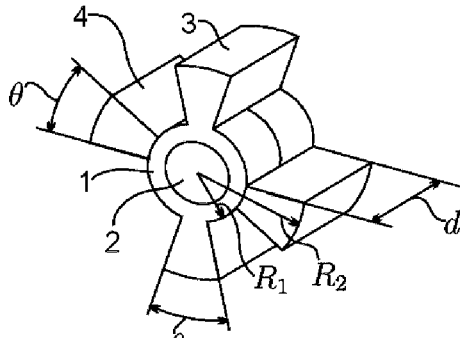
FIG. 3 is a diagram of the simplest version of the main unit of a RVM containing four identical vanes, two vanes to each shaft.

FIG. 3 depicts an example embodiment of the main unit of the simplest version of a RVM containing four identical vanes, with pairs of vanes 3 and 4 attached to shafts 1 and 2. θ is the angular dimension of a vane, d is the width of a vane, $R_1$ is the radius of shafts, and $R_2$ is the radius of vanes.

FIG. 4, FIG. 5, FIG. 6, FIG. 7 and FIG. 8 depict five consecutive positions of the vanes over two strokes. We use these figures to briefly summarize the coordinated rotation of vanes to execute the four strokes of the internal combustion cycle. Vanes attached to shaft 1 are marked by a single black dot, whereas vanes attached to shaft 2 are marked by two black dots in FIGS. 4 to 8. The vanes create between them chambers of variable volume: $c_1$, $c_2$, $c_3$, and $c_4$. The origin of the coordinate of the shafts is the horizontal ray directed to the right, labeled $k_0$ in FIGS. 4 to 8. The coordinate of shaft 1, $k_1$, is measured as the angle between the surface of the vane attached to shaft 1 which bounds chamber $c_1$ and ray $k_0$. Similarly, the coordinate of shaft 2, $k_2$, is measured as the angle between the surface of the vane attached to shaft 2 which bounds chamber $c_1$ and ray $k_0$.

Figure 4:
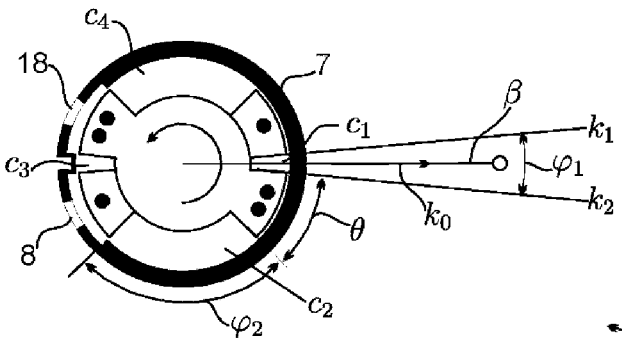
FIG. 4 depicts positions of the vanes at the beginning of the first stroke.

In FIG. 4 the angle between $k_1$ (starting position of shaft 1) and $k_0$ is considered positive, as the direction from $k_0$ to $k_1$ is anti-clockwise, whereas the angle between $k_0$ and $k_2$ (starting position of shaft 2) is negative. This coordinate choice for shafts is convenient because the difference in coordinates of the two shafts ($k_1-k_2$) gives the angular size of the chamber $c_1$. The bisector, β, of the angle between the two shafts is a ray starting from the center of rotation marked by a circle on its end. The coordinate of the bisector is the arithmetic mean of the coordinates of the two shafts $(k_1+k_2)/2$. The ignition device has a constant coordinate equal to $k_0$, it is not shown in FIGS. 4 to 8 so as not to clutter the drawings. Intake and exhaust openings are labeled as 8 and 18 respectively.

During the first stroke, from the instant of ignition of the fuel mixture in chamber $c_1$, this chamber increases its volume as it performs the working stroke. Chamber $c_2$ contracts compressing the fuel mixture as it performs the compression stroke. In chamber $c_3$ the intake stroke is carried out, and in chamber $c_4$ the exhaust stroke is carried out. In short, during the first stroke, chamber $c_1$ is the power chamber, $c_2$ is the compression chamber, $c_3$ is the intake chamber, and $c_4$ is the exhaust chamber. During this stroke, shaft 1 is leading, and shaft 2 is trailing.

Figure 5:
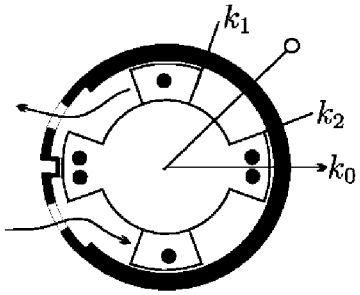
FIG. 5 depicts an intermediate position of the vanes between the beginning and end of the first stroke.
Figure 6:
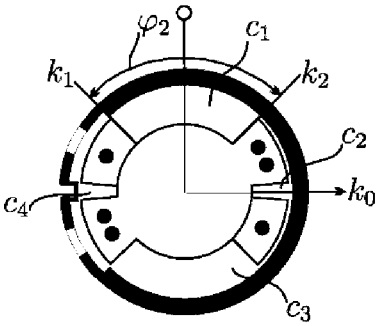
FIG. 6 depicts positions of the vanes at the end of the first stroke, which is also, the beginning of the second stroke.

Passing through an intermediate position shown in FIG. 5, at the end of the first stroke the vanes come to a position shown in FIG. 6. In this position chamber $c_1$ has expanded to the angle $\varphi_2$, shaft 1 has turned through an angle $\theta+\varphi_2$, shaft 2 has turned through an angle $\theta+\varphi_1$, and the bisector β of the angle between the shafts has rotated through 90 degrees.

A fresh portion of fuel mixture is now compressed in chamber $c_2$, ignition of this fuel mixture begins the second stroke. During the second stroke chamber $c_2$ is where the power stroke is carried out; chamber $c_3$ is where the compression stroke is carried out; chamber $c_4$ is where the intake stroke is carried out; and chamber $c_1$ is where the exhaust stroke is carried out.

Figure 7:
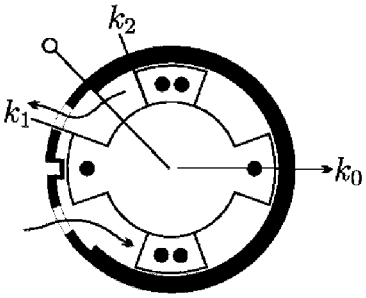
FIG. 7 depicts an intermediate position of the vanes between the beginning and end of the second stroke.
Figure 8:
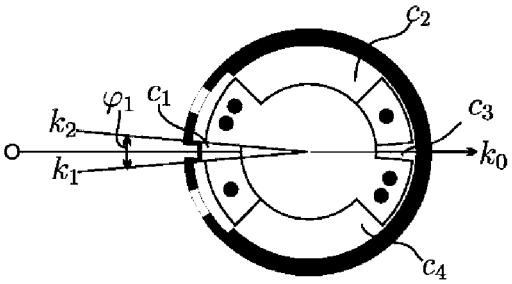
FIG. 8 depicts positions of the vanes at the end of the second stroke.

Similarly to the first stroke, during the second stroke the vanes pass through an intermediate position shown in FIG. 7, with their final position at the end of the second stroke shown in FIG. 8. FIG. 8 depicts that the exhaust stroke has ended in chamber $c_1$, and in chambers $c_2$, $c_3$ and $c_4$ the power, compression, and intake strokes have come to completion. During the second stroke, shaft 1 rotated through an angle $\theta+\varphi_1$, shaft 2 rotated through an angle $\theta+\varphi_2$, the angular width of chamber $c_1$ becomes equal to $\varphi_1$, and the bisector β of the angle between the shafts has rotated through another 90 degrees. During this stroke, shaft 1 is trailing, and shaft 2 is leading. As the positions of the vanes shown in FIG. 8 are equivalent to the positions of the vanes shown in FIG. 4, the time taken to perform these two strokes is considered the period of operation of the device.

In order for the above-described changes in the angles of the chambers, as well as the position of the chambers relative to the cylindrical casing to occur, rotation of the shafts should be coordinated. Below we present considerations underlying the disclosed method to achieve the required coordination using REM(s), in the simplest case, when the moments of inertia of the shafts are equal.

Let the pressures of gases in chambers $c_1$, $c_2$, $c_3$ and $c_4$ be equal to $p_1$, $p_2$, $p_3$ and $p_4$ respectively. Then, the torques acting on shaft 1 $\tau_1$ and shaft 2 $\tau_2$ due to these pressures are equal to:

$$\tau_1=(p_1-p_2+p_3-p_4)\cdot S\cdot l,$$

$$\tau_2=(-p_1+p_2-p_3+p_4)\cdot S\cdot l,$$

or, $$\tau_2=-\tau_1, \qquad \text{Equation 1}$$

where: S is the surface area of a vane ($d\cdot(R_2-R_1)$), and l lever arm ($(R_1+R_2)/2$), see FIG. 3.

From the above equation, we see that the torques applied by the gases to shaft 1 and shaft 2 are always equal in magnitude and opposite in direction. This means that if the gases induce acceleration in one shaft, the same acceleration, but in the opposite direction is induced in the other shaft. Consequently, the bisector of the angle between the shafts cannot obtain acceleration due to pressure applied by gases onto the vanes; the motion of the bisector is not dependent on interacting forces between the shafts. Only external torques (in our case torques applied by the REM(s)) whose algebraic sum is not equal to zero can cause the bisector of the angle between the shafts to accelerate.

Let us assume that in the position shown in FIG. 4 the initial speed of both shafts is equal to zero, the speed of the bisector $\omega_\beta$ is also equal to zero, ignition of the compressed fuel mixture occurs in chamber $c_1$, and external torques are applied to the shafts by the REMs. Shaft 2 experiences an external torque $\tau_0$ (in the anti-clockwise direction) from its REM, and shaft 1 experiences an external torque $-\tau_0$ (in the clockwise direction) from its REM. Assume also, that in the remaining three chambers the pressures of gases are atmospheric.

From this unstable state the system will begin non-harmonic periodic oscillation. Much like a spring pendulum, the system will be in the process of transferring internal energy of the gases to kinetic energy of the shafts, and back again. The period of this oscillation of the shafts depends on initial pressures of the gases, elastic properties of the gases, moments of inertia of the shafts, and magnitudes of the externally applied torques. During these oscillations, the coordinate of the bisector will experience zero acceleration.

If, at the starting moment the angular speed of bisector $\omega_\beta$ is not equal to zero, then the shafts will execute the same oscillations but relative to a rotating bisector. The rotating motion of the shafts will be the sum of two independent motions: oscillation of the shafts relative to the bisector, and uniform rotation of the bisector. If the initial speed of the bisector $\omega_0$ is such that it rotates 90 degrees in the time it takes for the chamber $c_1$, where the power stroke completes, and $c_1$ expands to angle $\varphi_2$, then the shafts will move from the positions shown in FIG. 4, to the positions shown in FIG. 6, which corresponds to the end of the first stroke. At the end of this first stroke, chamber $c_1$ is replaced by chamber $c_2$, which contains a newly compressed fuel mixture, and the system is ready to execute another stroke.

The RVM's vanes, with elastic gases between them form an oscillatory system. This property is exploited in the disclosed method and devices, utilizing the REM(s) to influence the period and amplitude of these oscillations, as well as the angle of rotation of the bisector during each stroke.

During continuous, uniform operation of the RVM, the processes occurring during each period should repeat themselves, and the speeds of the shafts at the end of each period should be equal to the speeds of the shafts at the start of each period. If, during a period the gases produced a given quantity of work by transferring energy to the shafts, then during this same period, an equivalent quantity of work should be done by the shafts against external torques applied by the REM(s). This means, that during a period, the sum of work done by the gases and work done by external torques is equal to zero, only then will the shafts neither loose nor gain kinetic energy, i.e. not increase or decrease their speed. The bisector of the angle between the shafts should rotate through 90 degrees with every stroke, and the angle between the shafts during a stroke should either increase from $\varphi_1$ to $\varphi_2$, or decrease from $\varphi_2$ to $\varphi_1$.

In the following examples we will show how these conditions are met for a RVM with one REM, and a RVM with a REM on each shaft. In these examples, the following assumptions are made:

- thermal and friction losses are negligible,
- compression and expansion processes of the gases are polytropic,
- work expended to intake and expel gases is negligible,
- torques exerted by REMs on the shafts during each stroke are constant.

All quantities not explicitly marked are by default given in SI units. Quantities given in non-SI units are labeled with the measurement unit used.

In FIG. 3 numerical values are equal to:

- radius of shafts, $R_1$=41.5 mm,
- radius of vanes, $R_2$=124.6 mm,
- width of vanes, d=83.1 mm,
- angular width of vanes, $\theta$=40 degrees, and hence,
- angular sum of adjacent chambers, ssa=$\pi-2\theta$=100 degrees, and
- inertial moments of shaft 1 and shaft 2, $J_1=J_2=0.215$ kgm$^2$.

Below are the thermodynamic parameters used in our calculations:

- compression ratio, CR=9,
- volume of adjacent chambers, $V_a$=1 L,
- polytropic compression index, $n_c$=1.3,
- polytropic expansion index, $n_e$=1.3,
- temperature increase at ignition of stoichiometric mixture: $\Delta T_i$=2000 K,
- initial temperature of compression: $T_2$=300 K,
- initial pressure of compression: $P_2$=100 kPa.

Using the above values, we calculate:

- angular width of compression chamber after compression, $\varphi_1$=10 degrees,
- angular width of compression chamber before compression, $\varphi_2$=90 degrees,
- volume of gas at start of compression, $V_2$=0.9 L,
- volume of gas at end of compression, $V_1$=0.1 L,
- work expended in compression of the fuel mixture, from a pressure $P_2$ and volume and $V_2$ to a volume $V_1$ is:

$$W_c = \frac{P_2 V_2}{n_c - 1}(1 - CR^{(n_c-1)}) = -278.95 \text{ J}, \quad \text{Equation 2}$$

at the end of this compression, pressure of the fuel mixture will increase to:

$$P_1 = P_2 \cdot CR^{n_c} = 1739.86 \text{ kPa, and} \quad \text{Equation 3}$$

and temperature will increase to:

$$T_1 = T_2 \cdot CR^{(n_c-1)} = 579.95K, \quad \text{Equation 4}$$

upon ignition of the compressed fuel mixture, the temperature inside the chamber will increase to:

$$T_e = T_1 + \Delta T_i = 2579.95K, \quad \text{Equation 5}$$

and pressure inside the compression chamber will increase to:

$$P_e = P_1 \frac{T_e}{T_1} = 7739.86 \text{ kPa}, \quad \text{Equation 6}$$

work done by the gas during expansion from a pressure $P_e$ and volume $V_1$, to a volume $V_2$ is:

$$W_e = \frac{P_e V_1}{n_e - 1}(1 - CR^{(1-n_e)}) = 1245.39 \text{ J}, \quad \text{Equation 7}$$

total work done during the compression-expansion process is:

$$W_T = W_c + W_e = 965.44 \text{ J}. \quad \text{Equation 8}$$

EXAMPLE 1

Example 1: describing the continuous, uniform operation of a RVM with one REM on one shaft, see FIG. 1. The mode of the REM is switched between motor and generator by the commutator. The REM attached to shaft 2 when operating as a motor increases the speed of rotation of shaft 2 consuming electrical energy, and decreases the speed of rotation of shaft 2 when operating as a generator.

As indicated earlier during a period of operation the energy of the shafts should not change, which is observed when the sum of work done by gases and externally applied torques during a period is equal to zero. During the first stroke the REM applies an accelerating torque $\tau_0$ to shaft 2, which adds energy to the shafts of the RVM, performing work equal to $\tau_0(\theta+\varphi_1)$. During the second stroke the REM applies a decelerating torque $-\tau_0$, which performs work equal to $-\tau_0(\theta+\varphi_2)$. The total work of these external moments during two strokes (period) is equal to:

$$\tau_0(\theta+\varphi_1)-\tau_0(\theta+\varphi_2)=-\tau_0(\varphi_2-\varphi_1). \quad \text{Equation 9}$$

The work of the gases during these two strokes is $2W_T$. To satisfy the necessary condition that the sum of work done by gases and externally applied torques during a period is equal to zero, we write:

$$-\tau_0(\varphi_2-\varphi_1)+2W_T=0, \quad \text{Equation 10}$$

from which we calculate the value of $\tau_0$:

$$\tau_0 = \frac{2W_T}{\varphi_2-\varphi_1} = 1382.89 \text{ Nm}. \quad \text{Equation 11}$$

Provided that an external torque $\tau_0$ is applied to shaft 2, and assuming that the initial speeds of the shafts and the bisector are equal to zero, we utilize the method of iteration to determine the time it takes for the ignited mixture to expand from volume $V_1$ to $V_2$, that is, the duration of a stroke $t_s$. We find $t_s$ equal to 21.53 ms. The angular rotation of the bisector $k_\beta$ is found by:

$$k_\beta = \frac{\tau_0 \cdot t_s^2}{2(J_1+J_2)} = 0.744 \text{ rad (42.64 degrees)}. \quad \text{Equation 12}$$

Using these values, we calculate the initial speed of the bisector $\omega_0$ at which the angle of rotation of the bisector will be 90 degrees during a stroke:

$$\omega_0 = \frac{\frac{\pi}{2}-k_\beta}{t_s} = 38.40 \text{ rad/s}. \quad \text{Equation 13}$$

Figure 9:
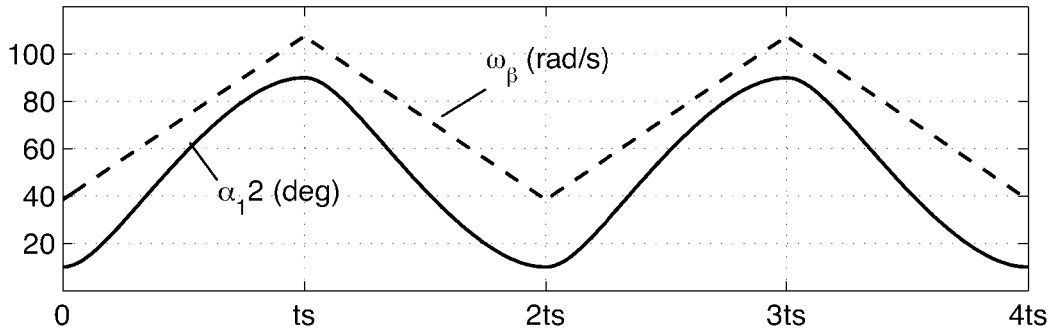
FIG. 9 plots the speed of the bisector (dashed line) and the angle between the shafts (continuous line) versus time, of an embodiment with one REM.
Figure 10:
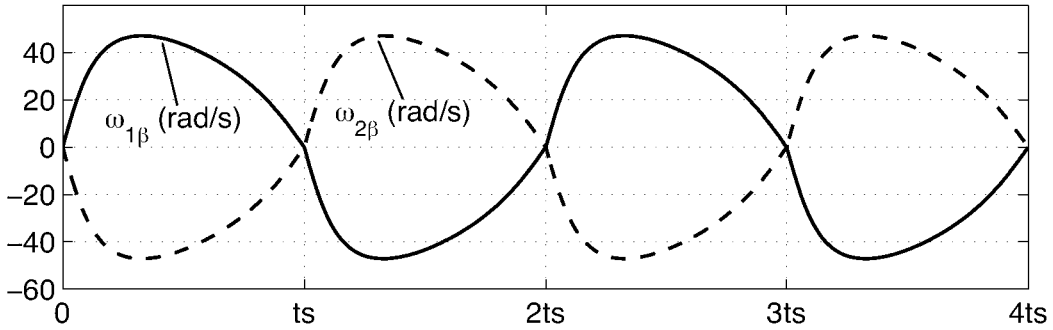
FIG. 10 plots the speed of shaft 1 relative to the bisector (continuous line) and speed of shaft 2 relative to the bisector (dashed line) versus time of an embodiment with one REM.

These calculations provide us with a description of the continuous, uniform operation of our disclosed RVM with one REM on shaft 2. Using the same iterative method we calculate the motion of the shafts with $\tau_0$ applied, and having an initial speed $\omega_0$. FIG. 9 plots the speed of the bisector $\omega_\beta$ (dashed line), and the angle between the shafts $\alpha_{12}$ (continuous line) as a function of time over four strokes. FIG. 10 plots the speed of shaft 1 relative to the bisector $\omega_{1\beta}$ (continuous line) and speed of shaft 2 relative to the bisector $\omega_{2\beta}$ (dashed line) as a function of time over four strokes. Table 1 lists values of the quantities in FIGS. 9 and 10 during four strokes divided into twenty equal time intervals. From table 1 we see that when the coordinate of the bisector takes on the values of 90, 180, 270 and 360 degrees, the angle between the shafts $\alpha_{12}$ becomes equal to 90, 10, 90 and 10 degrees respectively, which confirms the correct mutual rotation of the shafts, and their correct rotation relative to the static cylindrical casing.

TABLE 1

| n | $k_\beta$ (deg) | $\omega_1$ (rad/s) | $\omega_2$ (rad/s) | $\omega_\beta$ (rad/s) | $\alpha_{12}$ (deg) | $\omega_{1\beta}$ (rad/s) | $\omega_{2\beta}$ (rad/s) |
|---|---|---|---|---|---|---|---|
| 0 | 0 | 38.4 | 38.4 | 38.4 | 10 | 0 | 0 |
| 1 | 11.2 | 95.63 | 8.82 | 52.23 | 23.5 | 43.4 | −43.41 |
| 2 | 25.8 | 112.41 | 19.7 | 66.06 | 46.3 | 46.35 | −46.36 |
| 3 | 43.8 | 118.63 | 41.14 | 79.88 | 67.6 | 38.75 | −38.74 |
| 4 | 65.2 | 118.18 | 69.24 | 93.71 | 83.5 | 24.47 | −24.47 |
| 5 | 90 | 107.56 | 107.53 | 107.54 | 90 | 0.02 | −0.01 |
| 6 | 114.8 | 50.33 | 137.12 | 93.73 | 76.5 | −43.4 | 43.39 |
| 7 | 136.2 | 33.54 | 126.25 | 79.9 | 53.7 | −46.36 | 46.35 |
| 8 | 154.2 | 27.32 | 104.82 | 66.07 | 32.4 | −38.75 | 38.75 |
| 9 | 168.8 | 27.76 | 76.72 | 52.24 | 16.5 | −24.48 | 24.48 |
| 10 | 180 | 38.39 | 38.44 | 38.41 | 10 | −0.02 | 0.03 |
| 11 | 191.2 | 95.61 | 8.82 | 52.22 | 23.5 | 43.39 | −43.4 |
| 12 | 205.7 | 112.41 | 19.68 | 66.04 | 46.3 | 46.37 | −46.36 |
| 13 | 223.7 | 118.63 | 41.12 | 79.87 | 67.6 | 38.76 | −38.75 |
| 14 | 245.1 | 118.19 | 69.22 | 93.7 | 83.5 | 24.49 | −24.48 |
| 15 | 270 | 107.56 | 107.51 | 107.53 | 90 | 0.03 | −0.02 |
| 16 | 294.8 | 50.32 | 137.14 | 93.73 | 76.5 | −43.41 | 43.41 |
| 17 | 316.2 | 33.52 | 126.27 | 79.9 | 53.7 | −46.38 | 46.37 |
| 18 | 334.2 | 27.31 | 104.83 | 66.07 | 32.4 | −38.76 | 38.76 |
| 19 | 348.8 | 27.75 | 76.73 | 52.24 | 16.5 | −24.49 | 24.49 |
| 20 | 360 | 38.41 | 38.41 | 38.41 | 10 | 0 | 0 |

In summary, the engine parameters of this embodiment of our disclosed RVM with one REM are:

Power delivered to load: 45 kW (61 HP) at 697 RPM,

Engine displacement: 3.2 L,

Power of reversible electrical machine: 101 kW.

EXAMPLE 2

Example 2: describing the continuous, uniform operation of a RVM with one REM on shaft 1, and one REM on shaft 2, FIG. 2. The mode of both REMs is switched between motor and generator by the commutator. When an REM is operating as a motor it causes an increase in speed of rotation of the attached shaft consuming electrical energy, and when operating as a generator decreasing the speed of rotation of the shaft to which it is attached.

The numerical values provided for the dimensions of the main unit of a RVM are the same for this example, as are the thermodynamic characteristics.

During the first stroke REM 5 (FIG. 2) applies an accelerating moment $\tau_0$ to shaft 2 (trailing shaft) which performs work equal to $\tau_0(\theta+\varphi_1)$, whereas, shaft 1 (leading shaft) experiences a decelerating moment $-\tau_0$ from REM 6 (FIG. 2), which performs work equal to $-\tau_0(\theta+\varphi_2)$. During the second stroke, REM 5 applies a decelerating moment $-\tau_0$ to shaft 2 (now the leading shaft) which performs work equal to $-\tau_0(\theta+\varphi_2)$ and shaft 1 (now the trailing shaft) experiences an accelerating moment $\tau_0$ from REM 6, which performs work equal to $\tau_0(\theta+\varphi_1)$. The work done by both REMs during the first stroke is equal to:

$$\tau_0(\theta+\varphi_1)-\tau_0(\theta+\varphi_2)=-\tau_0(\varphi_2-\varphi_1). \quad \text{Equation 14}$$

The work done by both REMs during the second stroke is equal to:

$$\tau_0(\theta+\varphi_1)-\tau_0(\theta+\varphi_2)=-\tau_0(\varphi_2-\varphi_1). \quad \text{Equation 15}$$

The work of gases during a period is $2W_T$. Writing the condition for the sum of works of gases and external forces acting on the shafts to be equal to zero:

$$-2\tau_0(\varphi_2-\varphi_1)+2W_T=0, \quad \text{Equation 16}$$

we calculate the value of $\tau_0$:

$$\tau_0 = \frac{W_T}{\varphi_2-\varphi_1} = 691.44 \text{ Nm}. \quad \text{Equation 17}$$

Provided that an external torque $\tau_0$ is applied to shaft 2, an external torque $-\tau_0$ is applied to shaft 1, and assuming that the initial speeds of the shafts are equal to zero, we utilize the method of iteration to calculate the time it takes for the ignited mixture to expand from $V_1$ to $V_2$, that is, the duration of a stroke $t_s$. We find $t_s$ equal to 21.53 ms. The angle of rotation of the bisector during the stroke is equal to zero, as the sum of external moments from both REMs at every point in time is equal to zero. The initial speed of the bisector for the continuous, uniform operation of the RVM with two REMs, where the bisector rotates through 90 degrees during a stroke is:

$$\omega_0 = \frac{\frac{\pi}{2}}{t_s} = 72.97 \text{ rad/s.} \qquad \text{Equation 18}$$

Figure 11:
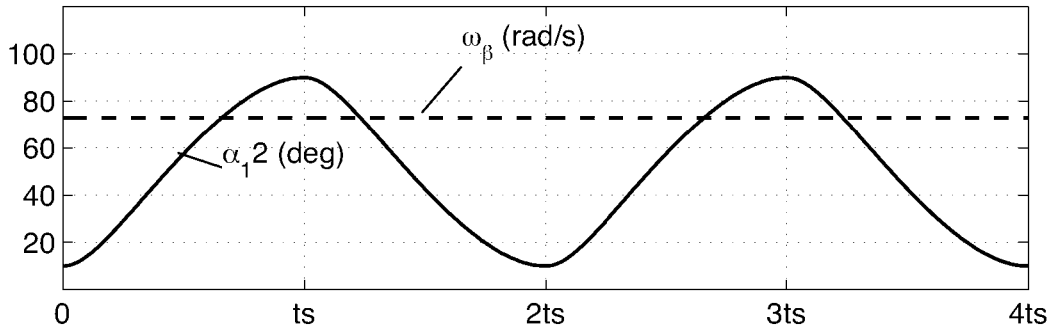
FIG. 11 plots the speed of the bisector (dashed line), and the angle between the shafts (continuous line) versus time of an embodiment with two REMs.
Figure 12:
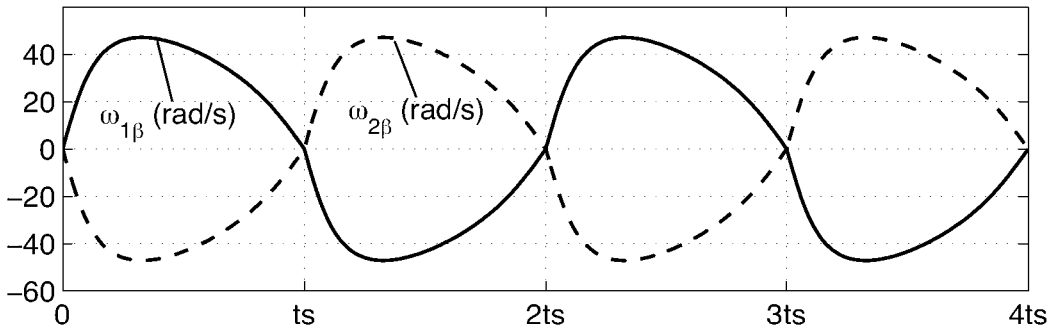
FIG. 12 plots the speed of shaft 1 relative to the bisector (continuous line) and speed of shaft 2 relative to the bisector (dashed line) versus time of an embodiment with two REMs.

These calculations provide us with a description of the continuous, uniform operation of our disclosed RVM with two REMs. Using the same iterative method we calculate the motion of the shafts with external torques applied to both shafts, and having an initial speed $\omega_0$. FIG. 11 plots the speed of the bisector $\omega_\beta$ (dashed line), and the angle between the shafts $\alpha_{12}$ (continuous line) as a function of time for four strokes. FIG. 12 plots the speed of shaft 1 relative to the bisector $\omega_{1\beta}$ (continuous line) and speed of shaft 2 relative to the bisector $\omega_{2\beta}$ (dashed line) as a function of time for four strokes. Table 2 lists values of the quantities in FIGS. 11 and 12 during four strokes divided into twenty equal time intervals. From table 2 we see that when the coordinate of the bisector takes on values of 90, 180, 270 and 360 degrees, the angle between the shafts $\alpha_{12}$ becomes equal to 90, 10, 90 and 10 degrees respectively, which confirms the correct mutual rotation of the shafts, and their correct rotation relative to the static cylindrical casing.

TABLE 2

| n | $k_\beta$ (deg) | $\omega_1$ (rad/s) | $\omega_2$ (rad/s) | $\omega_\beta$ (rad/s) | $\alpha_{12}$ (deg) | $\omega_{1\beta}$ (rad/s) | $\omega_{2\beta}$ (rad/s) |
|---|---|---|---|---|---|---|---|
| 0 | 0 | 72.97 | 72.97 | 72.97 | 10 | 0 | 0 |
| 1 | 18 | 116.38 | 29.57 | 72.97 | 23.5 | 43.4 | −43.4 |
| 2 | 36 | 119.33 | 26.62 | 72.97 | 46.3 | 46.35 | −46.35 |
| 3 | 54 | 111.72 | 34.23 | 72.97 | 67.6 | 38.74 | −38.74 |
| 4 | 72 | 97.44 | 48.5 | 72.97 | 83.5 | 24.47 | −24.47 |
| 5 | 90 | 72.99 | 72.96 | 72.97 | 90 | 0.01 | −0.01 |
| 6 | 108 | 29.58 | 116.37 | 72.97 | 76.5 | −43.4 | 43.4 |
| 7 | 126 | 26.62 | 119.33 | 72.97 | 53.7 | −46.36 | 46.36 |
| 8 | 144 | 34.23 | 111.72 | 72.97 | 32.4 | −38.75 | 38.75 |
| 9 | 162 | 48.49 | 97.45 | 72.97 | 16.5 | −24.48 | 24.48 |
| 10 | 180 | 72.95 | 73 | 72.97 | 10 | −0.03 | 0.03 |
| 11 | 198 | 116.37 | 29.58 | 72.97 | 23.5 | 43.4 | −43.4 |
| 12 | 216 | 119.34 | 26.61 | 72.97 | 46.3 | 46.36 | −46.36 |
| 13 | 234 | 111.73 | 34.22 | 72.97 | 67.6 | 38.76 | −38.76 |
| 14 | 252 | 97.46 | 48.49 | 72.97 | 83.5 | 24.49 | −24.49 |
| 15 | 270 | 73 | 72.95 | 72.97 | 90 | 0.03 | −0.03 |
| 16 | 288 | 29.56 | 116.39 | 72.97 | 76.5 | −43.41 | 43.41 |
| 17 | 306 | 26.6 | 119.35 | 72.97 | 53.7 | −46.37 | 46.37 |
| 18 | 324 | 34.21 | 111.74 | 72.97 | 32.4 | −38.76 | 38.76 |
| 19 | 342 | 48.49 | 97.46 | 72.97 | 16.5 | −24.49 | 24.49 |
| 20 | 360 | 72.97 | 72.97 | 72.97 | 10 | 0 | 0 |

In summary, the engine parameters of this embodiment of our disclosed RVM with two REMs are:

Power delivered to load: 45 kW (61 HP) at 697 RPM,

Engine displacement: 3.2 L,

Power of reversible electrical machine: 51 kW.

In both embodiments of the disclosed RVM with either one or two REM(s) the necessary coordination of the shafts is achieved with the REM(s) applying constant external torques. The function of the REM(s) is reduced to periodic removal of the energy generated by the gases, and it appears to be sufficient to reach necessary coordination of the shafts. In both examples, position sensors were not used, and no mention of the control of the angles or speeds of the shafts by a computing device is made.

In any practical realization of the disclosed methods and devices, feedback and control of the REM(s) is of course a practical necessity as deviations from continuous, uniform operation are inevitable. In practice, monitoring the position of both shafts is necessary by sensors that will inform the computing device of any deviations of the RVM from the expected operating state. A control system will act to compensate these deviations by applying necessary corrections to the torques generated by the REM(s).

INDUSTRIAL APPLICABILITY

The disclosed method and devices for coordination of rotation of the shafts of the rotary-vane engine using reversible electrical machines can be used in machine-generators that transform heat energy into electrical energy.

The invention claimed is:

1. A method for achieving coordinated rotation of shafts of a rotary-vane machine of the cat-and-mouse configuration which has two co-axial shafts with attached vanes creating between themselves chambers of variable volume, in which the strokes of intake, compression, power, and exhaust occur, with shaft position sensors, with a reversible electrical machine on one of the two co-axial shafts, with an electronic system for controlling currents in the reversible electrical machine, with an energy storage unit, and with an electrical load, the method comprising:

determining by calculation or empirically total work done by gases $W_T$ during the power and compression strokes, determining by calculation or empirically time of one stroke $t_s$ and angle of rotation of the bisector between the two co-axial shafts $k_{\beta 1}$ at any initial speed of the two co-axial shafts, $\omega_1$ during which the reversible electrical machine applies to the trailing shaft an accelerating torque which at angle $\theta+\varphi_1$ performs a work equal to:

$$2W_T(\theta+\varphi_1)/(\varphi_2-\varphi_1)$$

wherein $\theta$ is the angular width of a vane, $\varphi_1$ is the angular size of a chamber at the end of compression, $\varphi_2$ is the angular size of a chamber at the start of compression, calculating the initial speed of the two co-axial shafts $\omega_0$ at the beginning of the first stroke for continuous, uniform rotation:

$$\omega_o = \omega_1 + \frac{\frac{\pi}{N} - k_{\beta 1}}{t_s}$$

wherein N is number of vanes attached to each shaft, providing the two co-axial shafts with this initial speed $\omega_0$ for continuous, uniform rotation, during which the direction of torque applied by the reversible electrical machine alternates such that, when the shaft with the reversible electrical machine is trailing, an accelerating torque is applied which performs work during the stroke equal to $2W_T(\theta+\varphi_1)/(\varphi_{2-\varphi 1})$, whereas, when the shaft with the reversible electrical machine is leading, a decelerating torque is applied which performs work during the stroke equal to $-2W_T(\theta+\varphi_2)/(\varphi_2-\varphi_1)$, moreover the method does not contain any mechanical linkages which can influence rotation of the two co-axial shafts.

2. A rotary-vane machine-generator that utilizes the method of claim 1 for coordination of the two co-axial shafts.

3. A method for achieving coordinated rotation of shafts of a rotary-vane machine of the cat-and-mouse configuration which has two coaxial shafts with attached vanes creating between themselves chambers of variable volume, in which the strokes of intake, compression, power, and exhaust occur, with shaft position sensors, with reversible electrical machines on each shaft, with an electronic system for controlling the currents in the reversible electrical machines, with an energy storage unit, and with an electrical load, the method comprising:

determining by calculation or empirically total work done by gases $W_T$ during the power and compression strokes, determining by calculation or empirically time of one stroke $t_s$ during which the reversible electrical machine applies to the trailing shaft an accelerating torque which at angle $\theta+\varphi_1$ performs a work equal to:

$$W_T(\theta+\varphi_1)/(\varphi_2-\varphi_1)$$

wherein $\theta$ is the angular width of a vane, $\varphi_1$ is the angular size of a chamber at the end of compression, $\varphi_2$ is the angular size of a chamber at the start of compression, whereas the reversible electrical machine applies to the leading shaft an decelerating torque which at angle $\theta+\varphi_2$ performs a work equal to:

$$-W_T(\theta+\varphi_2)/(\varphi_2-\varphi_1)$$

calculating the initial speed of the two co-axial shafts $\omega_0$ for continuous, uniform rotation:

$$\omega_o = \frac{\frac{\pi}{N}}{t_s}$$

wherein N is number of vanes attached to each shaft, providing the two co-axial shafts with this initial speed $\omega_0$ for continuous, uniform rotation, during which the direction of torques applied by the reversible electrical machines alternates such that, during each stroke, an accelerating torque is applied to the trailing shaft which performs work equal to $W_T(\theta+\varphi_1)/(\varphi_2-\varphi_1)$, whereas a decelerating torque is applied to the leading shaft which performs work equal to $-W_T(\theta+\varphi_2)/(\varphi_2-\varphi_1)$ moreover the method does not contain any mechanical linkages which can influence rotation of the two co-axial shafts.

4. A rotary-vane machine-generator that utilizes the method of claim 3 for coordination of the two co-axial shafts.

5. A method of coordination of rotation of shafts of a rotary vane machine, of the cat-and-mouse configuration in the stationary mode of operation, which has two coaxial shafts, shaft 1 and shaft 2, with attached vanes creating between themselves chambers of variable volume where the strokes of an internal combustion engine occur, said machine which has shaft position sensors, a reversible computer controlled electrical machine at least on one of the two co-axial shafts, an electrical energy storage unit and an electrical load, the method comprising:

applying electromagnetic torques to shaft 1, if there is an electric machine on shaft 1, in such a way that when a pressure in the power chamber decelerates the shaft 1, the accelerating torque $T_1$ is applied and when a pressure in the power chamber accelerates the shaft 1, the decelerating torque $-T_1$ applied, applying electromagnetic torques to shaft 2, if there is an electric machine on shaft 2, in such a way that when a pressure in the power chamber decelerates the shaft 2, the accelerating torque $T_2$ is applied and when a pressure in the power chamber accelerates the shaft 2, the decelerating torque $-T_2$is applied, providing that the sum of the works performed by above mentioned electromagnetic torques and gases during two consecutive strokes is zero, complete absence of any mechanical linkages or devices that could affect the nature of the rotation of the two co-axial shafts.

6. Rotary vane machine of "cat and mouse" configuration with the method of coordination of rotation of the two co-axial shafts of claim 5, wherein thermal energy from burning fuel is converted into electrical energy by the reversible electric machine on one of the two co-axial shafts.

7. Rotary vane machine of "cat and mouse" configuration with the method of coordination of rotation of the two co-axial shafts of claim 5, wherein thermal energy from burning fuel is converted into electrical energy by the reversible electric machines on both of the two co-axial shafts.

* * * * *